US006360722B1

(12) United States Patent
Onishi

(10) Patent No.: US 6,360,722 B1
(45) Date of Patent: Mar. 26, 2002

(54) FUEL SUPPLY APPARATUS

(75) Inventor: Yoshihiko Onishi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/620,704

(22) Filed: Jul. 20, 2000

(30) Foreign Application Priority Data

Jan. 26, 2000 (JP) ..... 12-017473

(51) Int. Cl.[7] ..... F02M 33/04
(52) U.S. Cl. ..... 123/467; 123/446; 123/468
(58) Field of Search ..... 123/456, 468, 123/469, 509, 446–7, 467

(56) References Cited

U.S. PATENT DOCUMENTS

| | | | | |
|---|---|---|---|---|
| 5,230,613 A | * | 7/1993 | Hilsbos et al. | 123/456 |
| 5,329,899 A | * | 7/1994 | Sawert et al. | 123/198 DB |
| 5,404,855 A | * | 4/1995 | Yen et al. | 123/456 |
| 5,676,114 A | * | 10/1997 | Tarr et al. | 123/446 |
| 6,095,118 A | * | 8/2000 | Klinger et al. | 123/446 |
| 6,186,120 B1 | * | 2/2001 | Guentert et al. | 123/456 |
| 6,253,735 B1 | * | 7/2001 | Miyajima | 123/456 |

FOREIGN PATENT DOCUMENTS

| | | |
|---|---|---|
| JP | 10-77927 | 3/1998 |
| JP | 10-81223 | 3/1998 |
| JP | 11-210598 | 8/1999 |

* cited by examiner

*Primary Examiner*—Thomas N. Moulis
(74) *Attorney, Agent, or Firm*—Sughrue Mion, PLLC

(57) ABSTRACT

A fuel supply apparatus restrains occurrence of resonance at a connecting portion of a distal end of a low-pressure fuel intake pipe to thereby reduce surges in fuel pressure and control generation of noises. The fuel supply apparatus includes: a fuel tank; a low-pressure fuel pump provided in the fuel tank; a low-pressure fuel intake pipe having one end thereof connected to the low-pressure fuel pump; a first branch pipe having one end thereof connected to the other end of the low-pressure fuel intake pipe; a first high-pressure fuel supply assembly connected to the other end of the first branch pipe, and which pressurizes a low-pressure fuel into a high-pressure fuel and discharges the high-pressure fuel; a second branch pipe having one end thereof connected to the other end of the low-pressure fuel intake pipe; and a second high-pressure fuel supply assembly connected to the other end of the second branch pipe, and which pressurizes a low-pressure fuel from the low-pressure fuel intake pipe into a high-pressure fuel and discharges the high-pressure fuel, wherein the first branch pipe and the second branch pipe are composed of steel pipes.

11 Claims, 7 Drawing Sheets

FUEL SUPPLY APPARATUS

BACKGROUND OF THE INVENTION

1. Field of the Invention

The present invention relates to a fuel supply apparatus for supplying fuel to, for example, a direct injection engine.

2. Description of the Related Art

FIG. 5 is a fuel circuit diagram of a conventional fuel supply apparatus; FIG. 6 is a partially cut away general sectional view of a first high-pressure fuel supply assembly 100A shown in FIG. 5; and FIG. 7 is a sectional view of a valve assembly shown in FIG. 6.

The fuel supply apparatus includes: a fuel tank 1; a low-pressure fuel pump 2 provided in the fuel tank 1; a low-pressure fuel intake pipe 3 having one end thereof connected to the low-pressure fuel pump 2 and the other end thereof connected to the first high-pressure fuel supply assembly 100A and a second high-pressure fuel supply assembly 100B; a low-pressure regulator 4 branched from the low-pressure fuel intake pipe 3 and which sets a low-pressure fuel to a constant pressure; a first branch pipe 50A and a second branch pipe 50B having their one end connected to the other end of the low-pressure fuel intake pipe 3;

the first high-pressure fuel supply assembly 100A connected to the other end of the first branch pipe 50A; the second high-pressure fuel supply assembly 100B connected to the other end of the second branch pipe 50B; and a drainage pipe 17 connecting the first high-pressure fuel supply assembly 100A and the second high-pressure fuel supply assembly 100B to the fuel tank 1. Reference numeral 12 denotes a filter.

The first high-pressure fuel supply assembly 100A includes: a low-pressure damper 5 provided in a low-pressure fuel intake passage 51 and which absorbs surges in a low-pressure fuel; a high-pressure fuel pump 6 that pressurizes the low-pressure fuel from the low-pressure damper 5 and discharges it into a high-pressure fuel discharge passage7; a high-pressure damper 8 that absorbs surges in a high-pressure fuel flowing through the high-pressure fuel discharge passage 7; and a high-pressure regulator 10 disposed in a branch passage 9 branching from the high-pressure fuel discharge passage 7 at a branch portion 18 and which adjusts a high-pressure fuel to a predetermined pressure.

The high-pressure fuel pump 6 includes a valve assembly 20 for opening and closing the low-pressure fuel intake passage 51 and the high-pressure fuel discharge passage 7, and a high-pressure fuel supply body 21 for pressurizing a low-pressure fuel from the low-pressure fuel intake passage 51 and discharging it into the high-pressure fuel discharge passage 7.

The valve assembly 20 is constituted by a first plate 22, a second plate 23, and a thin-plate valve main body 19 sandwiched between the plates 22 and 23. A first fuel inlet 24 in communication with the low-pressure fuel intake pipe 3, and a first fuel outlet 25 which has an inside dimension larger than an inside dimension of the first fuel inlet 24 and which is communication with the high-pressure fuel discharge passage 7 are formed in the first plate 22. A second fuel inlet 26 having an inside dimension larger than that of the first fuel inlet 24, and a second fuel outlet 27 having an inside dimension smaller than that of the first fuel outlet 25 are formed in the second plate 23. The valve main body 19 has an intake-side tongue 28 interposed between the first fuel inlet 24 and the second fuel inlet 26, and a discharge-side tongue 29 interposed between the first fuel outlet 25 and the second fuel outlet 27.

The high-pressure fuel supply body 21 includes: a casing 30 that houses the valve assembly 20 in a first recess 30*a*; a cylindrical sleeve 31 housed in surface contact with the second plate 23 of the valve assembly 20; a piston 33 slidably inserted in the sleeve 31 to form a fuel pressurization chamber 32 in cooperation with the sleeve 31; and a first spring 36 disposed between a bottom surface 34 of the fuel pressurization chamber 32 and a holder 35 and which urges the piston 33 in a direction for expanding the volume of the fuel pressurization chamber 32.

The high-pressure fuel supply body 21 further includes: a housing 37 fitted over the sleeve 31; an annular securing member 38 which is fitted over the housing 37 and threadably attached to the first recess 30*a* of the casing 30 by means of an external thread portion 38*a* formed on an outer circumferential surface thereof, and which presses and secures the valve 20, the sleeve 31, and the housing 37 in the first recess 30*a* of the casing 30; a metal bellows 40 provided between the housing 37 and a receiving portion 39; a second spring 41 compressed and disposed between the housing 37 and a holder 42 at around an outer periphery of the bellows 40; and a bracket 43 provided to surround the second spring 41 and secured to the casing 30 by a screw (not shown).

The high-pressure fuel supply body 21 further includes: a tappet 44 slidably disposed in a slide bore 43*a* in an end portion of the bracket 43; a pin 45 rotatably penetrating the tappet 44; a bush 46 rotatably fitted to the pin 45; and a cam roller 47. A rotational motion of a cam shaft causes the pin 45, the tappet 44, and the piston 33 to reciprocate along a profile of the cam 52.

The high-pressure damper 8 is equipped with a diaphragm (not shown) formed of a stainless-steel thin disc that partitions between a back-pressure chamber (not shown) filled with a high-pressure gas and a buffer chamber (not shown). The diaphragm moves so that a pressure of fuel flowing into the buffer chamber from the high-pressure fuel discharge passage 7 is equalized with a pressure of the high-pressure gas in the back-pressure chamber, thereby changing a volume inside the buffer chamber to absorb surges in the fuel in the high-pressure fuel discharge passage 7.

The second high-pressure fuel supply assembly 100B shares the same a structure as that of the first high-pressure fuel supply assembly 100A. Components of the second high-pressure fuel supply assembly 100B will be assigned like reference numerals as the components of the first high-pressure fuel supply assembly 100A, and the descriptions thereof will not be repeated.

In the fuel supply assembly having the configuration set forth above, fuel in the fuel tank 1 flows through the low-pressure fuel intake pipe 3 as the low-pressure fuel pump 2 is driven, and the fuel is branched into the first branch pipe 50A and the second branch pipe 50B. The fuel branched into the first branch pipe 50A is supplied to the first high-pressure fuel supply assembly 100A, while the fuel branched into the second branch pipe 50B is supplied to the second high-pressure fuel supply assembly 100B.

In the first high-pressure fuel supply assembly 10A, the piston 33 reciprocates via the cam roller 47, the bush 46, the pin 45, and the tappet 44 when the drive cam 52 secured to the cam shaft of an engine rotates.

When the piston 33 descends (during a fuel intake stroke), the volume in the fuel pressurization chamber 32 increases, while the pressure in the fuel pressurization chamber decreases. When the pressure in the fuel pressurization chamber 32 falls below the pressure at the first fuel inlet 24, the intake-side tongue 28 of the valve main body 19 bends toward the second fuel inlet 26, allowing fuel in the low-pressure fuel intake passage 51 to flow through the first fuel inlet 24 into the fuel pressurization chamber 32.

When the piston 33 ascends (during a fuel discharge stroke), the pressure in the fuel pressurization chamber 32 increases, and when the pressure in the fuel pressurization chamber 32 rises above the pressure at the first fuel outlet 25, the discharge-side tongue 29 of the valve main body 19 bends toward the first fuel outlet 25, causing the fuel in the fuel pressurization chamber 32 to be fed through the first fuel outlet 25 and the fuel discharge passage 7 to the high-pressure damper 8 where fuel pressure surges are absorbed. The high-pressure fuel having its surges absorbed is supplied through a high-pressure pipe 16 into a first delivery pipe 13A, then supplied to individual cylinders (not shown) of the engine through fuel injection valves 14.

The fuel supplied to the second high-pressure fuel supply assembly 100B through the second branch pipe 50B undergoes the same operation as that in the first high-pressure fuel supply assembly 100A to increase its pressure in the second high-pressure fuel supply assembly 100B. The high-pressure fuel having its pressure increased is supplied into a second delivery pipe 13B through the high-pressure pipe 16, then supplied to the individual cylinders (not shown) of the engine through the fuel injection valves 14.

In the fuel supply assembly having the construction described above, if, for example, the fuel tank 1 is located at a rear of a vehicle body and the high-pressure fuel supply assemblies 100A and 100B are located in an engine room at a front of the vehicle body, then the low-pressure fuel intake pipe 3 is on a bottom surface of the vehicle body. In this case, the low-pressure fuel intake pipe 3 is required to have high strength, and it therefore uses a steel pipe having high rigidity. Directly connecting the low-pressure fuel intake pipe 3, which is a steel pipe, to the high-pressure fuel supply assemblies 100A and 100B has been posing the following problems.

a. Vibrations generated by the engine cause irregular repetitive load to be applied to the low-pressure fuel intake pipe 3, leading to deteriorated durability of the low-pressure fuel intake pipe 3. Furthermore, the vibrations are transmitted to the vehicle body, producing noises.

b. All the low-pressure fuel intake pipe 3, the vehicle body, and the engine require high dimensional accuracy.

In an attempt to solve the above problems, the first branch pipe 50A and the second branch pipe 50B, which are composed of flexible rubber pipes, are installed between the low-pressure fuel intake pipe 3, and the first high-pressure fuel supply assembly 100A and the second high-pressure fuel supply assembly 100B. In addition, a distal end portion of the low-pressure fuel intake pipe 3 is formed of a rubber pipe 53.

However, in the fuel supply assembly having the construction set forth above, if the drive cam 52 of the first high-pressure fuel supply assembly 100A and the drive cam 52 of the second high-pressure fuel supply assembly 100B are driven in the same phase, or in opposite phases in order to stabilize fuel pressure surges in the fuel in the low-pressure fuel intake pipe 3, then the pressure surges in the low-pressure fuel intake pipe that are generated in the first high-pressure fuel supply assembly 100A and the second high-pressure fuel supply assembly 100B generally merge in the same phase or opposite phases at a connecting portion A, which is a merging portion. On the other hand, the first branch pipe 50A and the second branch pipe 50B in the conventional assembly are composed of the flexible rubber pipes that elastically deform. Hence, pressure fluctuations passing through the branch pipes develop a phase shift, and resonance attributable to the phase shift occurs at the merging portion, namely, the connecting portion A, resulting in increased pressure surges. This has been presenting a problem in that the increased pressure surges cause the low-pressure fuel supply pipe to vibrate, generating noises.

Basically, the drive frequencies of the first high-pressure fuel supply assembly 100A and the second high-pressure fuel supply assembly 100B are fixed, so that the phase shift occurs in a fixed value. The occurrence of the resonance could be controlled by adjusting the phases of the drive cams 52 of the first high-pressure fuel supply assembly 100A and the second high-pressure fuel supply assembly 100B by predicting a phase shift value. However, since the first branch pipe 50A and the second branch pipe 50B are rubber pipes, their physical properties, such as elasticity, change due to air temperature and the phase shift accordingly changes, making it impossible to restrain the occurrence of the resonance.

SUMMARY OF THE INVENTION

Accordingly, the present invention has been made with a view toward solving the problems described above, and it is an object thereof to provide a fuel supply apparatus that restrains the occurrence of resonance at a connecting portion at a distal end of a low-pressure fuel intake pipe so as to reduce fuel pressure surges and control occurrence of noises.

To this end, according to a first aspect of the present invention, there is provided a fuel supply apparatus wherein a first branch pipe and a second branch pipe connected to a low-pressure fuel intake pipe are composed of rigid pipes.

According to a second aspect of the present invention, there is provided a fuel supply apparatus wherein a coupling pipe connected to a connecting portion of a low-pressure fuel intake pipe and a first high-pressure fuel supply assembly is composed of a rigid pipe.

In a preferred form of the present invention, the other end portion of the low-pressure fuel intake pipe is composed of a flexible pipe.

In another preferred form of the present invention, the rigid pipe is a steel pipe.

In a further preferred form of the present invention, the flexible pipe is a rubber pipe.

DESCRIPTION OF THE PREFERRED EMBODIMENTS

First Embodiment

Figure 1:
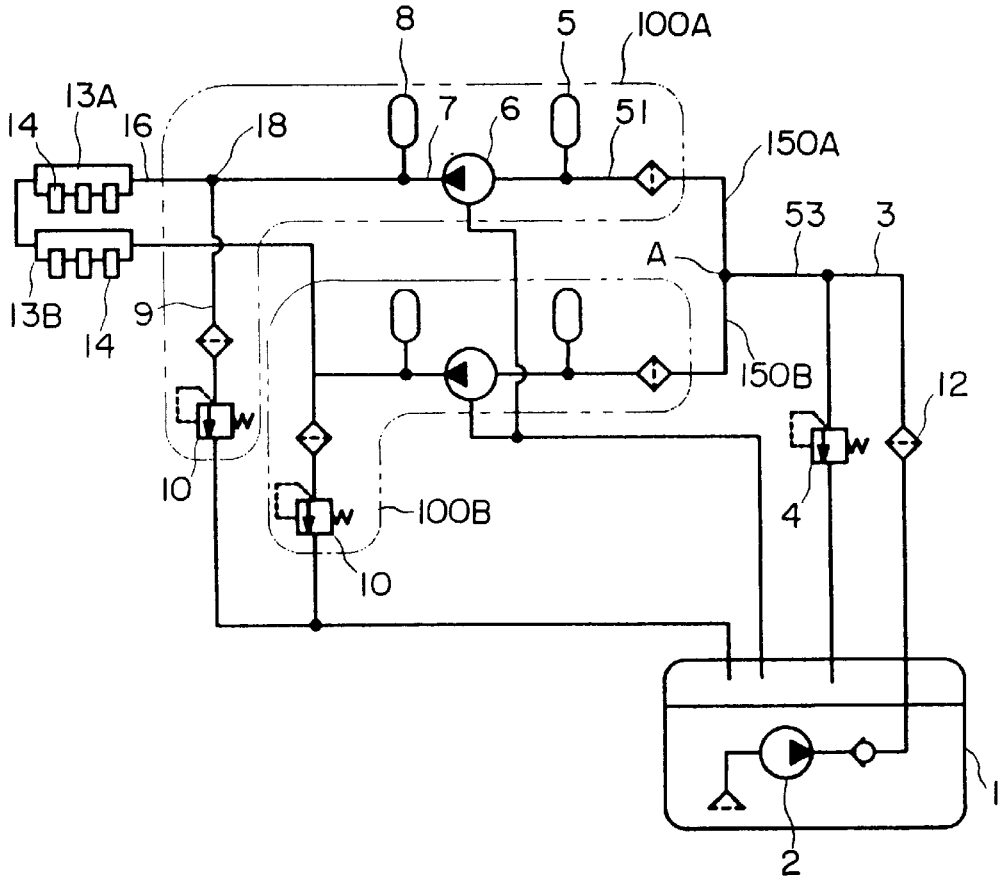
FIG. 1 is a fuel circuit diagram of a fuel supply assembly of a first embodiment in accordance with the present invention.
Figure 2:
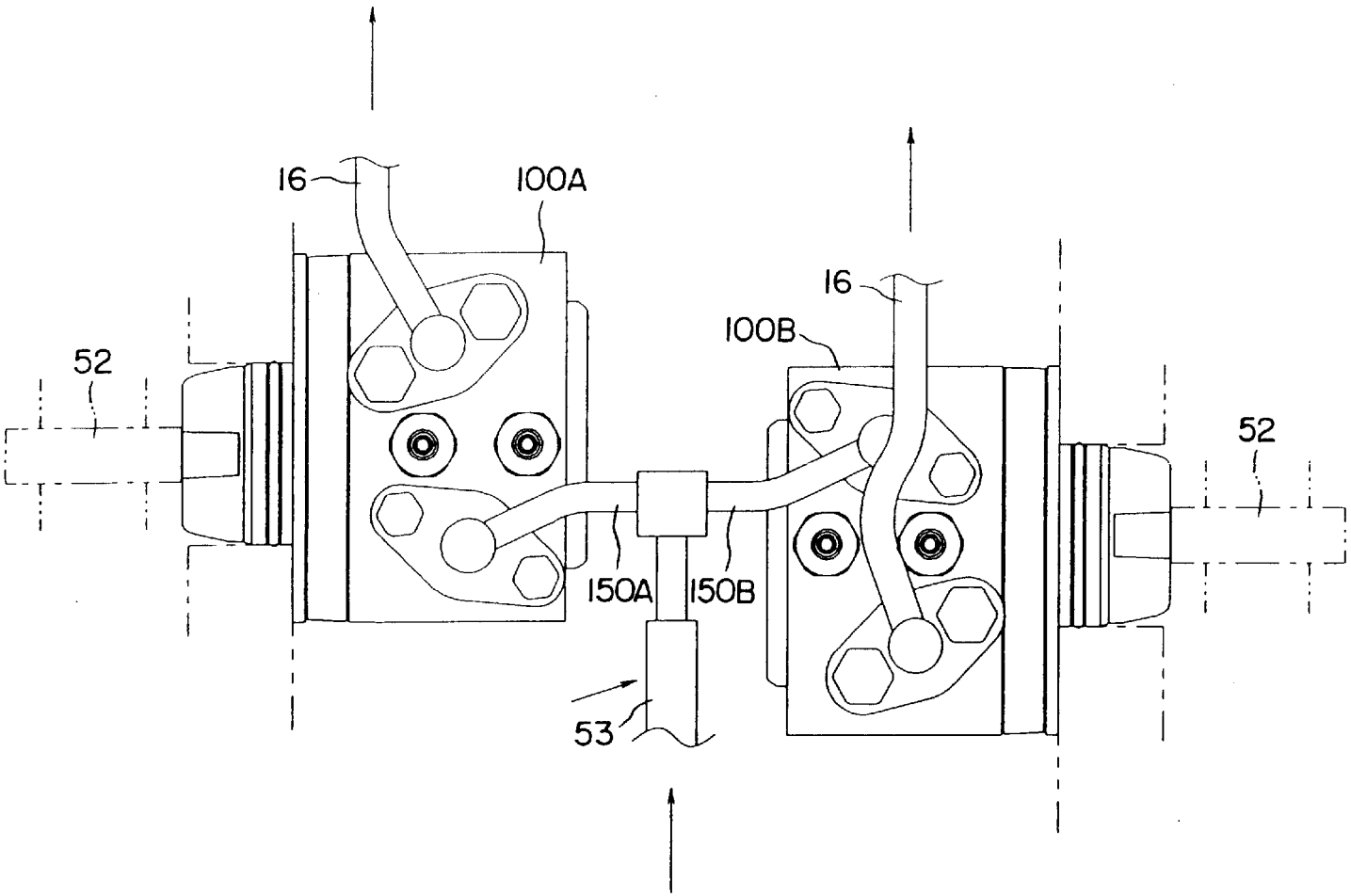
FIG. 2 is a top plan view of an essential section of the fuel supply apparatus shown in FIG. 1.
Figure 5:
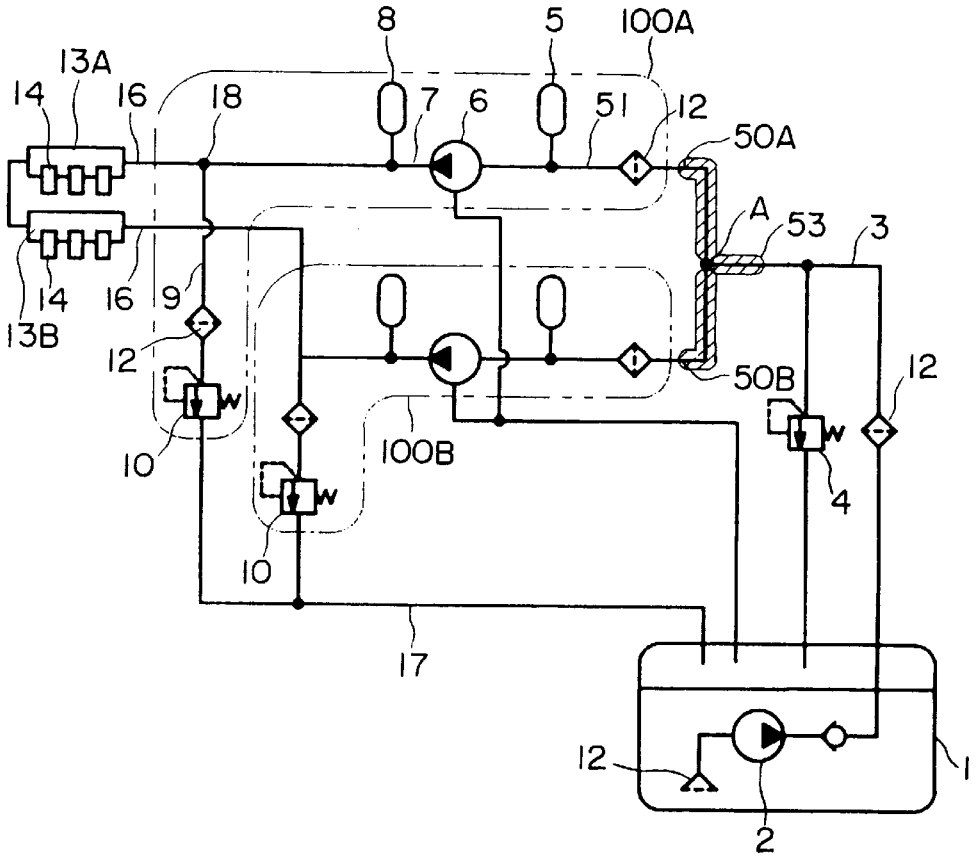
FIG. 5 is a fuel circuit diagram of a conventional fuel supply apparatus.
Figure 6:
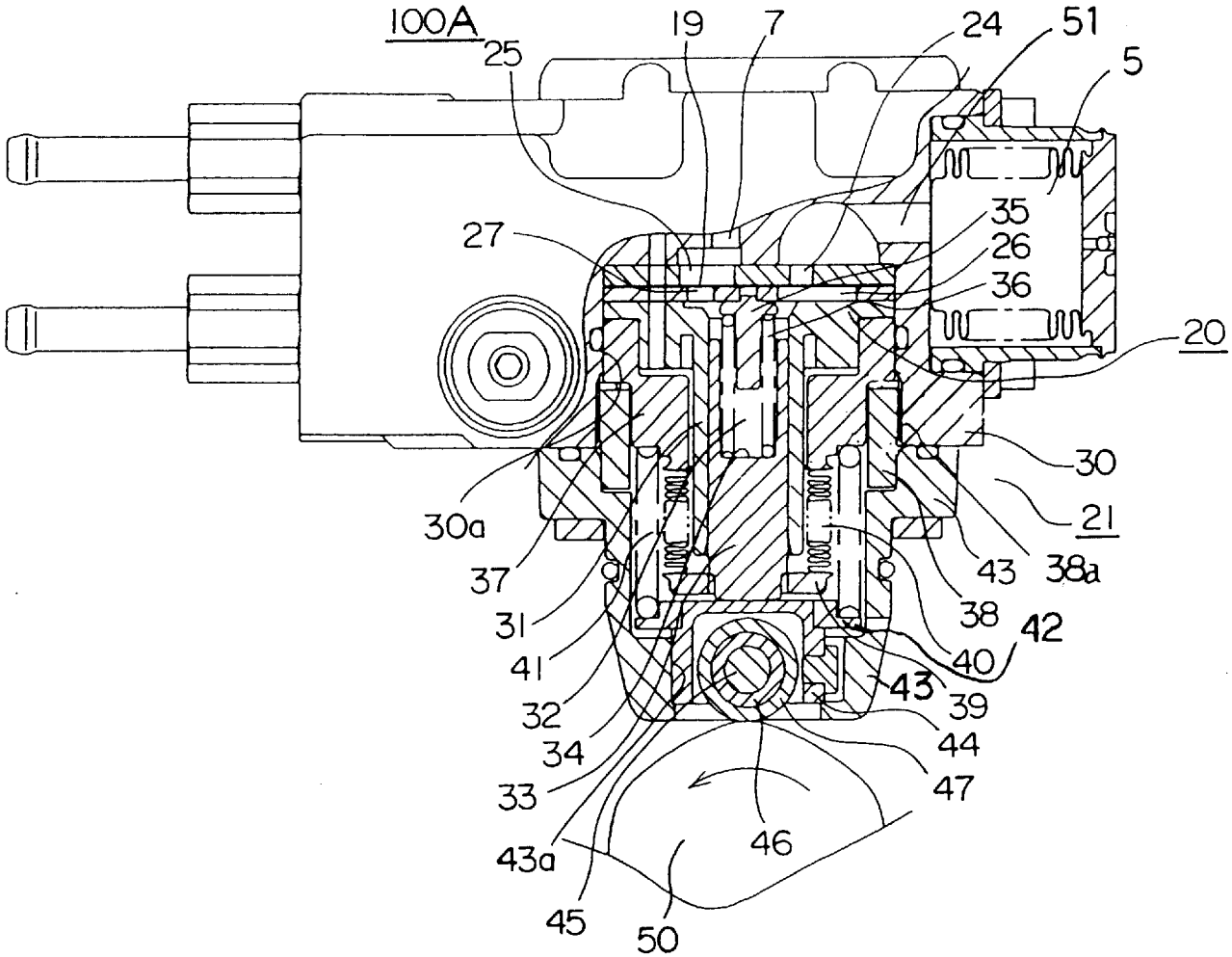
FIG. 6 is a partially cut away sectional view of a first high-pressure fuel supply assembly shown in FIG. 5.
Figure 7:
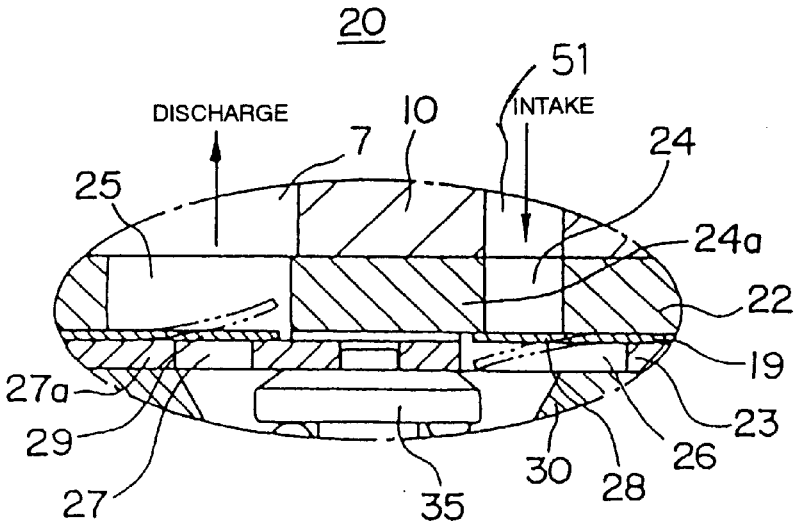
FIG. 7 is a sectional view of a valve assembly of a high-pressure fuel pump shown in FIG. 5.

A fuel supply apparatus in accordance with the present invention will now be described. FIG. 1 is a fuel circuit diagram of a fuel supply apparatus of a first embodiment in accordance with the present invention; and FIG. 2 is a top plan view of an essential section of the fuel supply apparatus shown in FIG. 1. The same or equivalent components as those shown in FIG. 5 through FIG. 7 will be assigned like reference numerals in explanation.

The fuel supply apparatus includes: a fuel tank 1; a low-pressure fuel pump 2 provided in the fuel tank 1; a low-pressure fuel intake pipe 3 having one end thereof connected to the low-pressure fuel pump 2 and the other end thereof connected to the first high-pressure fuel supply assembly 100A and a second high-pressure fuel supply assembly 100B; a low-pressure regulator 4 branched from the low-pressure fuel intake pipe 3 and which sets a low-pressure fuel to a constant pressure; a first branch pipe 150A and a second branch pipe 150B having their one end connected to the other end of the low-pressure fuel intake pipe 3; the first high-pressure fuel supply assembly 100A connected to the other end of the first branch pipe 150A; the second high-pressure fuel supply assembly 100B connected to the other end of the second branch pipe 150B; and a drainage pipe 17 connecting the first high-pressure fuel supply assembly 100A and the second high-pressure fuel supply assembly 100B to the fuel tank 1. The first branch pipe 150A and the second branch pipe 150B are formed of steel pipes, which are rigid pipes. A distal end portion of the low-pressure fuel intake pipe 3 is formed of a rubber pipe 53, which is a flexible pipe. Reference numeral 12 denotes a filter.

In the fuel supply apparatus having the configuration set forth above, fuel in the fuel tank 1 flows through the low-pressure fuel intake pipe 3 as the low-pressure fuel pump 2 is driven, and the fuel is branched into the first branch pipe 150A and the second branch pipe 150B. The fuel branched into the first branch pipe 150A is supplied to the first high-pressure fuel supply assembly 100A, while the fuel branched into the second branch pipe 150B is supplied to the second high-pressure fuel supply assembly 100B.

The low-pressure fuel is increased in pressure in the first high-pressure fuel supply assembly 100A so as to be turned into a high-pressure fuel, and this high-pressure fuel is supplied through a high-pressure pipe 16 into a first delivery pipe 13A, then supplied to individual cylinders (not shown) of the engine through fuel injection valves 14.

Similarly, the low-pressure fuel supplied through the second branch pipe 150B into the second high-pressure fuel supply assembly 100B is increased in pressure in the second high-pressure fuel supply assembly 100B so as to be turned into a high-pressure fuel, then this high-pressure fuel is supplied to the individual cylinders (not shown) of the engine through the fuel injection valves 14.

In the fuel supply apparatus having the construction set forth above, when a drive cam 52 of the first high-pressure fuel supply assembly 100A and the drive cam 52 of the second high-pressure fuel supply assembly 100B are driven in the same phase, or in opposite phases in order to stabilize fuel pressure surges in the fuel in the low-pressure fuel intake pipe 3, chances of the occurrence of a phase shift are minimized because the first branch pipe 150A and the second branch pipe 150B are composed of steel pipes, which are rigid pipes. Hence, the occurrence of resonance at a connecting portion A of the distal end portion of the low-pressure fuel intake pipe 3 is restrained. As a result, surges of fuel can be restrained, permitting reduced possibilities of generation of noises.

In addition, the other end portion of the low-pressure fuel intake pipe 3 is formed of the rubber pipe 53, which is a flexible pipe. Therefore, vibration load transmitted to the low-pressure fuel intake pipe 3 is reduced, the vibration load coming from the vibration of the first branch pipe 150A and the second branch pipe 150B attributable to vibration of the engine. This arrangement makes it possible to protect the low-pressure fuel intake pipe 3 from damage and also to restrain noises generated from the vibration.

Figure 3:
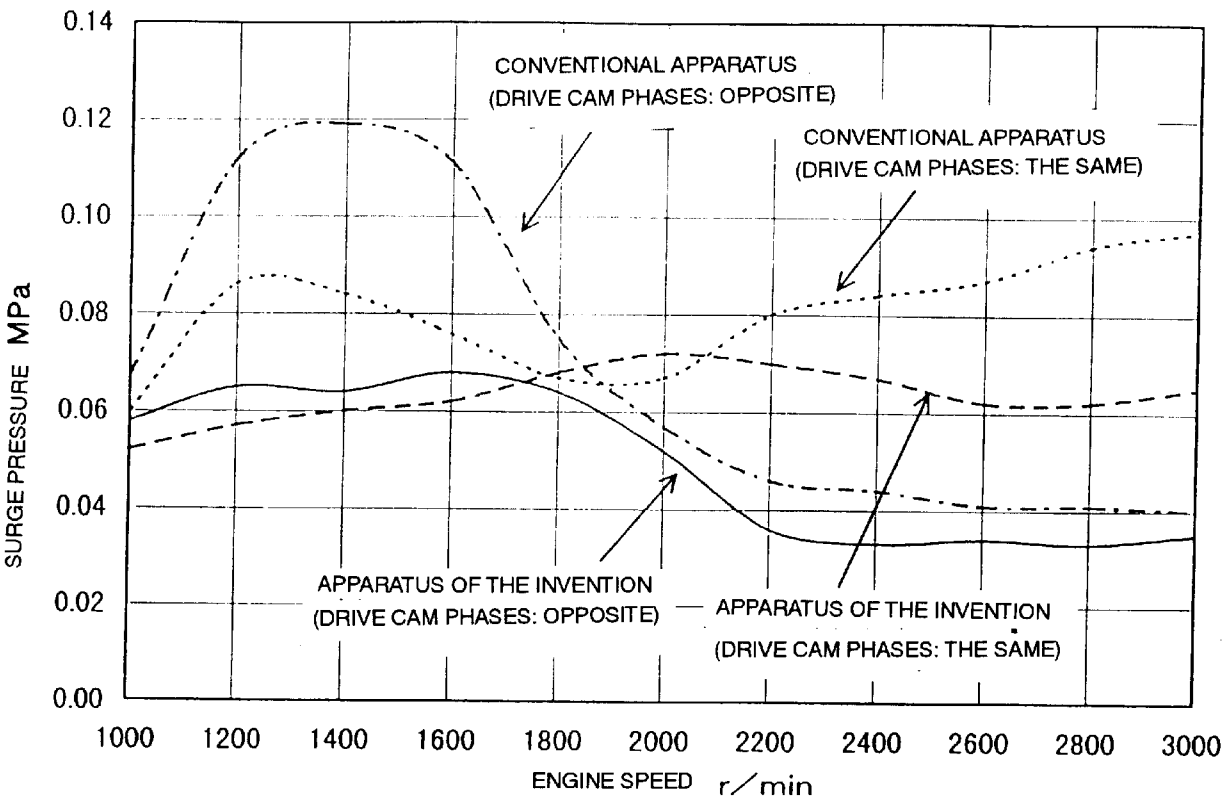
FIG. 3 is a surge characteristic chart showing a comparison between the first embodiment and a conventional example.

FIG. 3 is a surge characteristic chart prepared based on experiments by the present inventors. In the case of a conventional example, resonance occurs in a low speed range (less than 2000 rpm) of engine speed, and surges of fuel pressure in the vicinity of the connecting portion A in the low-pressure fuel intake pipe 3 grow larger. In a high speed range (2000 rpm or more), if the drive cams 52 of the first high-pressure fuel supply assembly 100A and the second high-pressure fuel supply assembly 100B are in opposite phases, then the surges in the fuel pressure are reduced, as compared with a case where the drive cams 52 are in the same phase, as can be seen in the chart.

In the case of the first embodiment, it can be seen that resonance does not occur when an engine speed is in the low speed range, and the surges in the fuel pressure are generally reduced whether the cam phases are the same or opposite, as compared with the conventional example.

Second Embodiment

Figure 4:
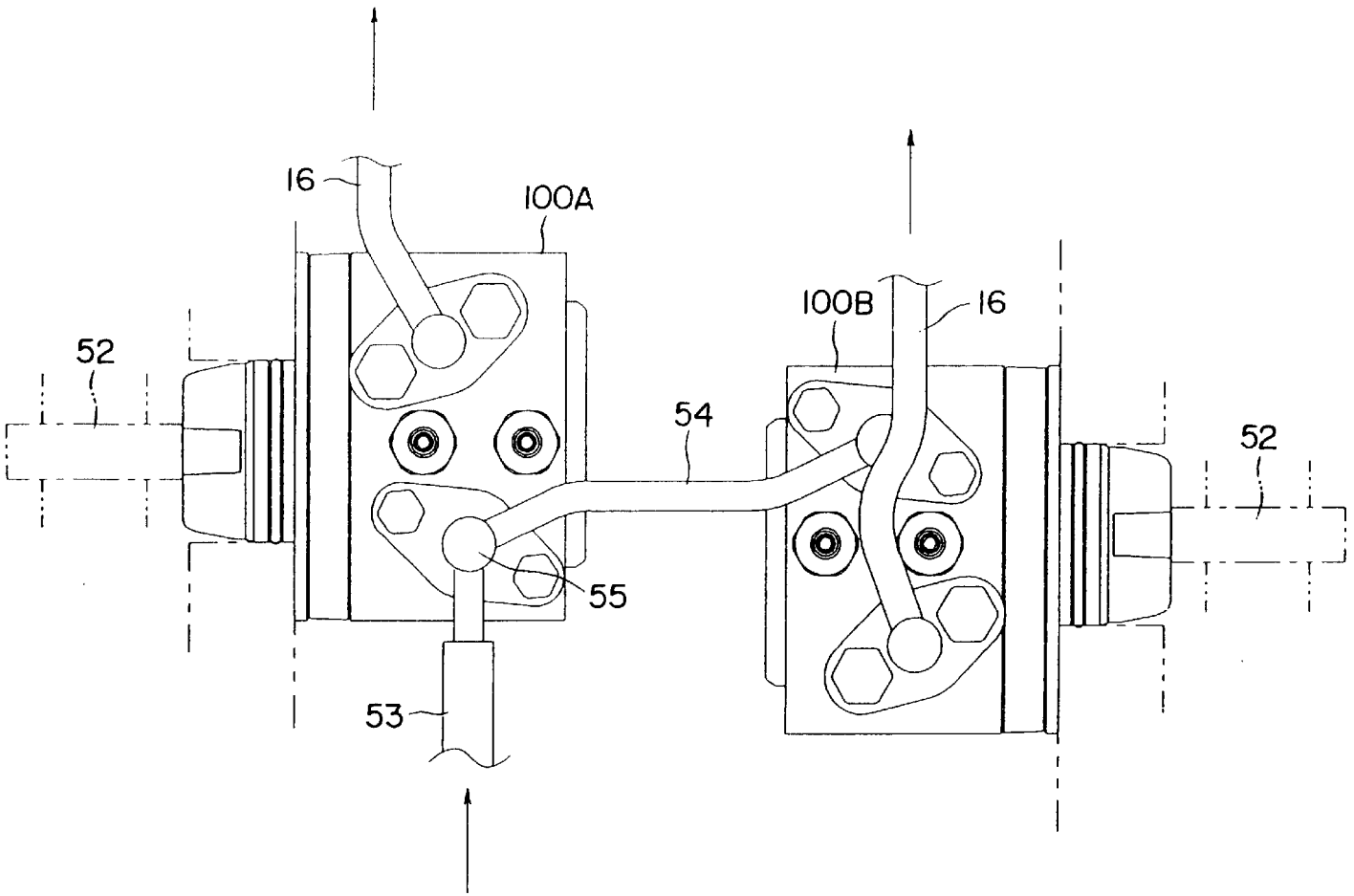
FIG. 4 is a top plan view of an essential section of a fuel supply apparatus of a second embodiment in accordance with the present invention.

FIG. 4 is a top plan view showing an essential section of a fuel supply assembly of a second embodiment. A rubber pipe 53 constituting an end portion of a low-pressure fuel intake pipe 3 is directly connected to a first high-pressure fuel supply assembly 100A. One end of a coupling pipe 54 composed of a steel pipe, which is a rigid pipe, is connected to a connecting portion 55. The other end of the coupling pipe 54 is connected to a second high-pressure fuel supply assembly 100B.

In the first embodiment, the rubber pipe 53 of the low-pressure fuel intake pipe 3 is supported by the first high-pressure fuel supply assembly 100A and the second high-pressure fuel supply assembly 100B via the first branch pipe 150A and the second branch pipe 150B. Hence, a separate support member for supporting the low-pressure fuel intake pipe 3 is required to prevent the repetitive load applied to the low-pressure fuel intake pipe 3 from affecting the first branch pipe 150A, the second branch pipe 150B, and the connecting portion A.

In the second embodiment, the low-pressure fuel intake pipe 3 is directly supported by the first high-pressure fuel supply assembly 100A. Therefore, the repetitive load applied to the low-pressure fuel intake pipe 3 is received by the first high-pressure fuel supply assembly 100A, obviating the need for the separate support member for supporting the low-pressure fuel intake pipe 3. In the second embodiment, a distance between the low-pressure fuel intake pipe 3 and the first high-pressure fuel supply assembly 100A and a distance between the low-pressure fuel intake pipe 3 and the second high-pressure fuel supply assembly 100B are different. More specifically, the distance to the second high-pressure fuel supply assembly 100B is longer by a length of the coupling pipe 54. The slight difference in pipe length, however, hardly leads to the occurrence of a phase shift. Even if a phase shift should occur, the phase shift can be controlled by adjusting the phases of the drive cams 52.

Thus, according to the fuel supply apparatus of the present invention, the first branch pipe and the second branch pipe connected to the low-pressure fuel intake pipe are formed of rigid pipes. Hence, the occurrence of resonance at the connecting portion, which is the distal end portion, of the low-pressure fuel intake pipe is restrained, allowing the surges in fuel pressure to be reduced and also allowing the generation of noises to be controlled.

Furthermore, the coupling pipe connected to the connecting portion that links the low-pressure fuel intake pipe and the first high-pressure fuel supply assembly is formed of a rigid pipe. Therefore, the occurrence of resonance at the connecting portion, which is the distal end portion, of the low-pressure fuel intake pipe is restrained, allowing the surges in fuel pressure to be reduced and also allowing the generation of noises to be controlled.

Moreover, the other end portion of the low-pressure fuel intake pipe is formed of a flexible pipe, so that the flexible pipe absorbs irregular repetitive load applied to the low-pressure fuel intake pipe, thus protecting the low-pressure fuel intake pipe from damage and also permitting a lengthwise dimensional error of the low-pressure fuel intake pipe to be absorbed. This leads to easier and efficient work for connecting the low-pressure fuel intake pipe with the first branch pipe and the second branch pipe.

In addition, steel pipes are used for the rigid pipes, permitting improved economy.

Furthermore, rubber pipes are used for the flexible pipes, permitting improved economy.

What is claimed is:

1. A fuel supply apparatus comprising:

a fuel tank;

a low-pressure fuel pump provided in the fuel tank;

a low-pressure fuel intake pipe having one end thereof connected to the low-pressure fuel pump;

a first branch pipe having one end thereof connected to the other end of the low-pressure fuel intake pipe;

a first high-pressure fuel supply assembly which is connected to the other end of the first branch pipe, pressurizes a low-pressure fuel from the low-pressure fuel intake pipe into a high-pressure fuel, and discharges the high-pressure fuel;

a second branch pipe having one end thereof connected to the other end of the low-pressure fuel intake pipe; and a second high-pressure fuel supply assembly which is connected to the other end of the second branch pipe, pressurizes a low-pressure fuel from the low-pressure fuel intake pipe into a high-pressure fuel, and discharges the high-pressure fuel;

wherein the first branch pipe and the second branch pipe are composed of rigid pipes so as to restrain fuel pressure surges in said low-pressure fuel intake pipe.

2. A fuel supply apparatus comprising:

a fuel tank;

a low-pressure fuel pump provided in the fuel tank;

a low-pressure fuel intake pipe having one end thereof connected to the low-pressure fuel pump;

a first high-pressure fuel supply assembly connected to the other end of the low-pressure fuel intake pipe, and which pressurizes a low-pressure fuel from the low-pressure fuel intake pipe into a high-pressure fuel and discharges the high-pressure fuel;

a coupling pipe having one end thereof connected to a portion where the low-pressure fuel intake pipe and the first high-pressure fuel supply assembly are connected; and a second high-pressure fuel supply assembly connected to the other end of the coupling pipe, and pressurizes a low-pressure fuel from the low-pressure fuel intake pipe into a high-pressure fuel and discharges the high-pressure fuel;

wherein the coupling pipe is composed of a rigid pipe so as to restrain fuel pressure surges in said low-pressure fuel intake pipe.

3. A fuel supply apparatus according to claim 1, wherein the other end of the low-pressure fuel intake pipe is composed of a flexible pipe.

4. A fuel supply apparatus according to claim 1, wherein the rigid pipe is a steel pipe.

5. A fuel apparatus according to claim 3, wherein the flexible pipe is a rubber pipe.

6. A fuel supply apparatus comprising:

a fuel tank;

a low-pressure fuel pump connected to the fuel tank;

a low-pressure fuel intake pipe having one end thereof connected to the low-pressure fuel pump;

a first branch pipe having one end thereof connected to the other end of the low-pressure fuel intake pipe, said first branch pipe having first means for restraining fuel pressure surges in said low-pressure fuel intake pipe;

a first high-pressure fuel supply assembly which is connected to the other end of the first branch pipe, pressurizes a low-pressure fuel from the low-pressure fuel intake pipe into a high-pressure fuel, and discharges the high-pressure fuel;

a second branch pipe having one end thereof connected to the other end of the low-pressure fuel intake pipe, said second branch pipe having second means for restraining fuel pressure surges in said low-pressure fuel intake pipe; and a second high-pressure fuel supply assembly which is connected to the other end of the second branch pipe, pressurizes a low-pressure fuel from the low-pressure fuel intake pipe into a high-pressure fuel, and discharges the high-pressure fuel.

7. The fuel supply apparatus according to claim 6, wherein said first branch pipe and said second branch pipe are composed of steel.

8. The fuel supply apparatus according to claim 6, wherein said low-pressure fuel pump is provided in the fuel tank.

9. A fuel supply apparatus comprising:

a fuel tank;

a low-pressure fuel pump coupled to the fuel tank;

a low-pressure fuel intake pipe having one end thereof connected to the low-pressure fuel pump;

a first high-pressure fuel supply assembly connected to the other end of the low-pressure fuel intake pipe, and which pressurizes a low-pressure fuel from the low-pressure fuel intake pipe into a high-pressure fuel and discharges the high-pressure fuel;

a coupling pipe having one end thereof connected to a portion where the low-pressure fuel intake pipe and the first high-pressure fuel supply assembly are connected, said coupling pipe further having means for restraining fuel pressure surges in said low-pressure fuel intake pipe; and a second high-pressure fuel supply assembly connected to the other end of the coupling pipe, and pressurizes a low-pressure fuel from the low-pressure fuel intake pipe into a high-pressure fuel and discharges the high-pressure fuel.

10. The fuel supply apparatus according to claim 9, wherein said coupling pipe is composed of steel.

11. The fuel supply apparatus according to claim 6, wherein said low-pressure fuel pump is provided in the fuel tank.

* * * * *